United States Patent [19]

Bean et al.

[11] Patent Number: 5,017,301

[45] Date of Patent: May 21, 1991

[54] METHOD FOR PERMANGANATE BLEACHING OF FABRIC AND GARMENTS

[75] Inventors: Samuel L. Bean, Wilmington, Del.; Mark D. Dulik, West Chester, Pa.; Peter A. Monopoli, Wilmington, Del.

[73] Assignee: General Chemical Corporation, Parsippany, N.J.

[21] Appl. No.: 278,833

[22] Filed: Dec. 2, 1988

Related U.S. Application Data

[63] Continuation-in-part of Ser. No. 149,217, Jan. 27, 1988, Pat. No. 4,795,476.

[51] Int. Cl.[5] ..... C11D 7/54; D06L 3/00; B01D 19/00

[52] U.S. Cl. ..... 252/105; 252/188.21; 252/188.22; 8/107; 8/110; 8/111

[58] Field of Search ..... 8/107, 102, 110, 111; 252/186.33, 186.2, 188.21, 188.22

[56] References Cited

U.S. PATENT DOCUMENTS

| | | | |
|---|---|---|---|
| 3,472,609 | 10/1969 | Panto et al. | 8/107 |
| 4,093,417 | 6/1978 | Heinlein et al. | 8/137 |
| 4,218,220 | 8/1980 | Kappler et al. | 8/102 |
| 4,421,664 | 12/1983 | Anderson et al. | 252/94 |
| 4,795,476 | 1/1989 | Bean et al. | 8/107 |

FOREIGN PATENT DOCUMENTS 2136029A 9/1984 United Kingdom .

OTHER PUBLICATIONS

Advanced Inorganic Chemistry, F. Albert Cotton, Geoffrey Wilkinson, F.R.S., Interscience Publishers, 1972, pp. 446–449.

*Primary Examiner*—Paul Lieberman
*Assistant Examiner*—John F. McNally
*Attorney, Agent, or Firm*—Brumbaugh, Graves, Donohue & Raymond

[57] ABSTRACT

Permanganate based fabric bleaching processes, such as stone-washing processes, are substantially improved by utilizing a reducing composition comprising a metabisulfite and a sulfite in the washing step. The relative amounts of metabisulfite and sulfite in the reducing composition are selected so as to substantially eliminate the odor of sulfur dioxide during the washing step at the particular temperature selected. For washing temperatures of 100°–140° F. the preferred weight ratio of sodium metabisulfite to sodium sulfite is 7:3, which produces a reducing composition having a pH of 6.2 (in a 5% by weight solution). Such a composition not only allows operation at elevated temperatures without an odor of $SO_2$, it also allows a reduction in the washing time and in the amount of reducing composition used.

10 Claims, No Drawings

METHOD FOR PERMANGANATE BLEACHING OF FABRIC AND GARMENTS

This application is a continuation-in-part of U.S. patent application Ser. No. 149,217 filed Jan. 27, 1988 now U.S. Pat. No. 4,795,476.

BACKGROUND OF THE INVENTION

The present invention relates to a composition for reducing a permanganate bleaching agent following its use in the bleaching of fabric which substantially reduces or eliminates the odor of sulfur dioxide, even when the reduction is carried out at elevated temperatures.

Garments having a faded or stone-washed appearance, particularly those made of blue denim, currently enjoy a considerable market, and several methods are known for chemically fading the fabric. For example, U.S. Pat. No. 4,218,220 and UK Patent Application No. 2 136 029 A both describe methods which avoid the actual use of stones in preparing faded fabrics. Nevertheless, commercial processes continue to utilize pumice stones in the preparation of faded fabrics.

In one such process, wet garments or fabric are tumbled in a commercial-type washing machine with abradable pumice stones which have been saturated with 3% potassium permanganate. The garments emerge from the "stone-wash" part of the process stained a rust brown color by the permanganate. This staining is removed in a subsequent washing step during which the permanganate is reduced to colorless water soluble materials.

In the known process, the permanganate is reduced with sodium metabisulfite, although other components such as optical brightners may also be added during the washing step. The use of sodium metabisulfite, however, results in a strong odor of sulfur dioxide ($SO_2$) if high wash temperatures are employed. Thus, wash temperatures of 60°-70° F. are used, even though this increases the wash time required.

It is the object of the present invention to provide an improved reducing composition for use in permanganate-based fabric bleaching which permits the use of higher wash temperatures while substantially reducing or eliminating the odor of $SO_2$.

SUMMARY OF THE INVENTION

According to the invention, permanganate based fabric bleaching processes, such as stone-washing processes, are substantially improved by utilizing a reducing composition comprising a metabisulfite and a sulfite in the washing step. The relative amounts of metabisulfite and sulfite in the reducing composition are selected so as to substantially eliminate the odor of sulfur dioxide during the washing step at the particular temperature selected. For washing temperatures of 100°-140° F. the preferred weight ratio of sodium metabisulfite to sodium sulfite is 7:3, which produces a reducing composition having a pH of 6.2 (in a 5% by weight solution). Such a composition not only allows operation at elevated temperatures without an odor of $SO_2$, it also allows a reduction in the washing time and in the amount of reducing composition used.

The compositions of the invention include sulfite and metabisulfite and one or more additives such as optical brighteners that improve the fabric appearance. A preferred additive is a fluorescent whitening agent such as Tinopal CBS-X (Ciba Geigy). This material is used at a level which is effective as an optical brightener, preferably 1500 to 4000 ppm. Detergents may also be included to improve fabric appearance.

DETAILED DESCRIPTION OF THE INVENTION

Mixtures comprising metabisulfite and sulfite were found to be effective reducing agents for use in accordance with the invention so long as the ratio of metabisulfite to sulfite in the composition is maintained such that a 5% solution having that ratio would have a pH below about 6.5 (mole ratio of metabisulfite to sulfite=0.6). On the other hand, reducing compositions having too low a pH, i.e. below about 5.8 for a 5% solution (mole ratio=3.2) did not have a significant impact on the sulfur dioxide odor associated with the washing process. It is therefore preferred to carry out the improved process of the invention using a reducing agent having a pH (in 5% solution) between about 6.1 and about 6.3. This corresponds to a mole ratio of sodium metabisulfite to sodium sulfite of from 1.8 to 1.1.

The actual pH of the reducing composition required to eliminate the $SO_2$ odor will depend on the temperature at which the wash is performed. At 100°-140° F. a pH of 6.2 is preferred, although at lower temperatures lower pH's may be used.

The combined metabisulfite/sulfite reducing agent of the invention is advantageously used in the wash cycle in concentrations from about 0.4% to about 1%. Lower amounts may be used if higher wash temperatures are employed.

The advantageous properties of the claimed invention are demonstrated in the following examples.

EXAMPLE 1

A reducing composition was prepared by mixing 70 lbs. of anhydrous sodium metabisulfite and 30 lbs. of anhydrous sodium sulfite. The pH of a 5% solution of this mixture was 6.2. The reducing composition was then used in preparing stone-washed jeans as follows:

Sixty-four permanganate-stained garments were placed in a commercial washing machine. In accordance with normal processing practice using metabisulfite alone, the reducing composition was added in three washing steps, two four minute steps followed by a ten minute step. A total of 28.2 lbs. of reducing composition was used in the three washing steps; 7 lbs. in the first step, 7 lbs. in the second step, and 14.2 lbs. in the third step. The temperature throughout the washing was maintained at 70° F. No sulfur dioxide odor was detectable, and the appearance of the garments was good.

EXAMPLE II

The reducing composition of Example I was used to wash an additional 64 permanganate-stained garments using a three-step washing cycle. In this case, the total amount of reducing composition was reduced to 24 lbs. (6 lbs. in each of the first and second steps and 12 lbs. in the third step) and the temperature of the washing process was raised to 130°-140° F. Again, there was no detectable odor of sulfur dioxide and the garment appearance was good.

EXAMPLE III

The reducing composition of Example I was used to wash an additional 64 permanganate-stained garments at 130°–140° F. In this case, however, 12 lbs. of reducing composition was used in each of the two 4 minutes washing steps, and the 10 minute step was eliminated. Again, there was no detactable odor of sulfur dioxide, and the garment appearance was good.

EXAMPLE IV

The reducing composition of Example I was used to wash an additional 64 permanganate-stained garments at 130°–140° F. In this case, however, 6 lbs. of reducing composition was used in each of the two 4 minutes steps, and the 10 minute step was eliminated. Again, there was no detectable odor of sulfur dioxide, and the garment appearance was good.

COMPARATIVE EXAMPLE 22.7 lbs. of sodium metabisulfite was used to wash 64 permanganate-stained garments using a three-step washing procedure at 70° F. in accordance with the established commercial procedure (5.7 lbs. in each of two 4 minutes washes, followed by 11.4 lbs. in a ten minute wash). There was some odor of sulfur dioxide detectable, and the appearance of the washed garments was good.

The examples above utilize mixtures of a solid metabisulfite and a solid sulfite to achieve reducing compositions having the desired ratio of metabisulfite to sulfite. The invention can also be practiced by generating the sulfite in situ as a result of the reaction of a metabisulfite with a base such as sodium carbonate. The amount of base added should be sufficient to achieve the preferred ratio of metabisulfite to sulfite. For example, 5.2 grams of $Na_2CO_3$ is appropriately added to 30 g of sodium metabisulfite.

The use of the reducing agent in accordance with the invention not only substantially reduces or eliminates the odor of sulfur dioxide which ordinarily accompanies the washing step following permanganate bleaching, it does so even at temperatures much higher than those generally considered useful because of the odor problem. This increase in temperature permits both a reduction of processing time by more than 50% and a reduction of the amount of reducing composition by 50% or more while yielding comparable results.

We claim:

1. A reducing composition for use in permanganate bleaching comprising sodium metabisulfite and sodium sulfite which can be added to wash cycle during permanganate bleaching to produce a final concentration in the wash cycle of from 0.4% to 1.0% reducing composition, wherein the metabisulfite and the sulfite are present in amounts such that substantially no sulfur dioxide odor is detectable upon addition of the composition to a permanganate-containing bleaching solution.

2. A reducing composition according to claim 1, wherein metabisulfite and sulfite are present in a mole ratio of between 0.6 and about 3.2.

3. A reducing composition according to claim 2, wherein the mole ratio is between 1.1 and about 1.8.

4. A reducing composition according to claim 1 further comprising a detergent.

5. A reducing composition according to claim 1, further comprising an optical brightner.

6. A reducing composition according to claim 1, wherein the composition is a solid.

7. A reducing composition according to claim 6, wherein metabisulfite and sulfite are present in a mole ratio of between 0.6 and about 3.2.

8. A reducing composition according to claim 7, wherein the mole ratio is between 1.1 and about 1.8.

9. A reducing composition according to claim 6, further comprising a detergent.

10. A reducing composition according to claim 6, further comprising an optical brightner.

* * * * *